US008758056B2

(12) United States Patent
Zhang et al.

(10) Patent No.: US 8,758,056 B2
(45) Date of Patent: Jun. 24, 2014

(54) INPUT/OUTPUT CONNECTOR MOUNTING APPARATUS

(75) Inventors: Xiang Zhang, Wuhan (CN); Chao Geng, Wuhan (CN); Biao Zeng, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 189 days.

(21) Appl. No.: 13/450,586

(22) Filed: Apr. 19, 2012

(65) Prior Publication Data

US 2013/0149900 A1 Jun. 13, 2013

(30) Foreign Application Priority Data

Dec. 12, 2011 (CN) ..... 2011 01 0411740

(51) Int. Cl.
*H01R 13/648* (2006.01)

(52) U.S. Cl.
USPC ..... 439/607.01; 439/607.23

(58) Field of Classification Search
USPC ..... 439/607.01, 607.02, 607.23, 607.25, 439/607.53–607.56
See application file for complete search history.

(56) References Cited

U.S. PATENT DOCUMENTS

| | | | | |
|---|---|---|---|---|
| 7,559,801 | B1 * | 7/2009 | Lin et al. | 439/607.01 |
| 8,408,940 | B2 * | 4/2013 | Chang | 439/607.01 |
| 8,469,744 | B2 * | 6/2013 | Nichols et al. | 439/607.01 |
| 8,500,493 | B2 * | 8/2013 | Liu et al. | 439/660 |
| 8,529,295 | B2 * | 9/2013 | Sasaki et al. | 439/607.01 |

* cited by examiner

*Primary Examiner* — Khiem Nguyen
(74) *Attorney, Agent, or Firm* — Novak Druce Connolly Bove + Quigg LLP

(57) ABSTRACT

A mounting apparatus for mounting an I/O connector includes a base having a chamber for accommodating the I/O connector, a cover engaged with the base thereby fixing the I/O connector in the chamber, a shielding case for receiving the base and the cover, and a resilient piece having a first end abutting the shielding case and a second end abutting a housing of the I/O connector.

20 Claims, 7 Drawing Sheets

INPUT/OUTPUT CONNECTOR MOUNTING APPARATUS

BACKGROUND

1. Technical Field

The present disclosure relates to a mounting apparatus, and particularly to a mounting apparatus for mounting an input/output connector with low electromagnetic interference leakage.

2. Description of Related Art

An input/output (I/O) connector is a robust connector electrically connected to various circuits for interfacing signals between different peripheral devices and a host computer. However the signal transmission through the I/O connector results in electromagnetic interference (EMI) leakage. Therefore, a need may be desired to provide a low EMI leakage solution for mounting the I/O connector.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
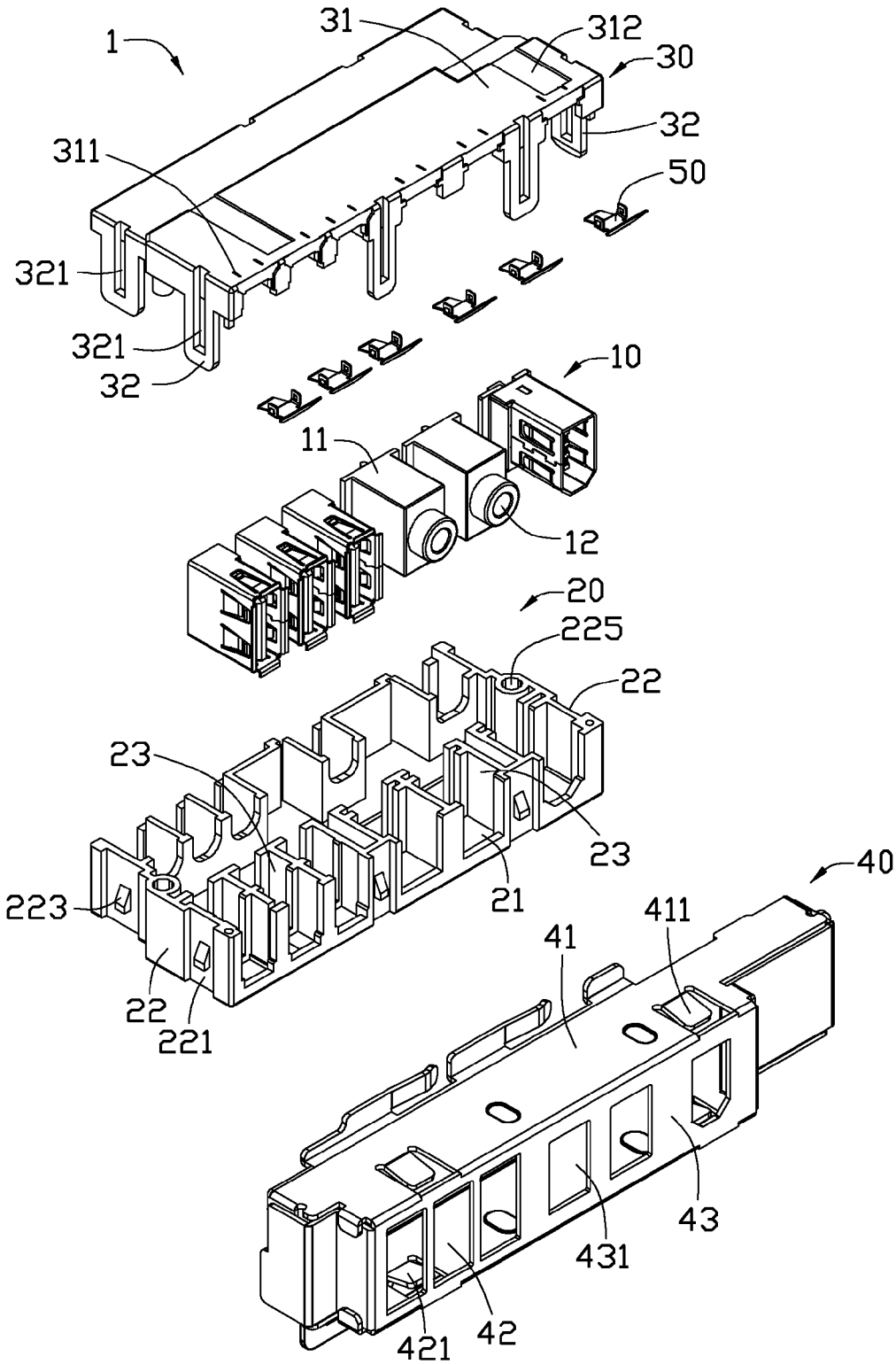
FIG. 1 is an exploded, isometric view of a mounting apparatus for mounting I/O connectors in accordance with an embodiment.
Figure 2:
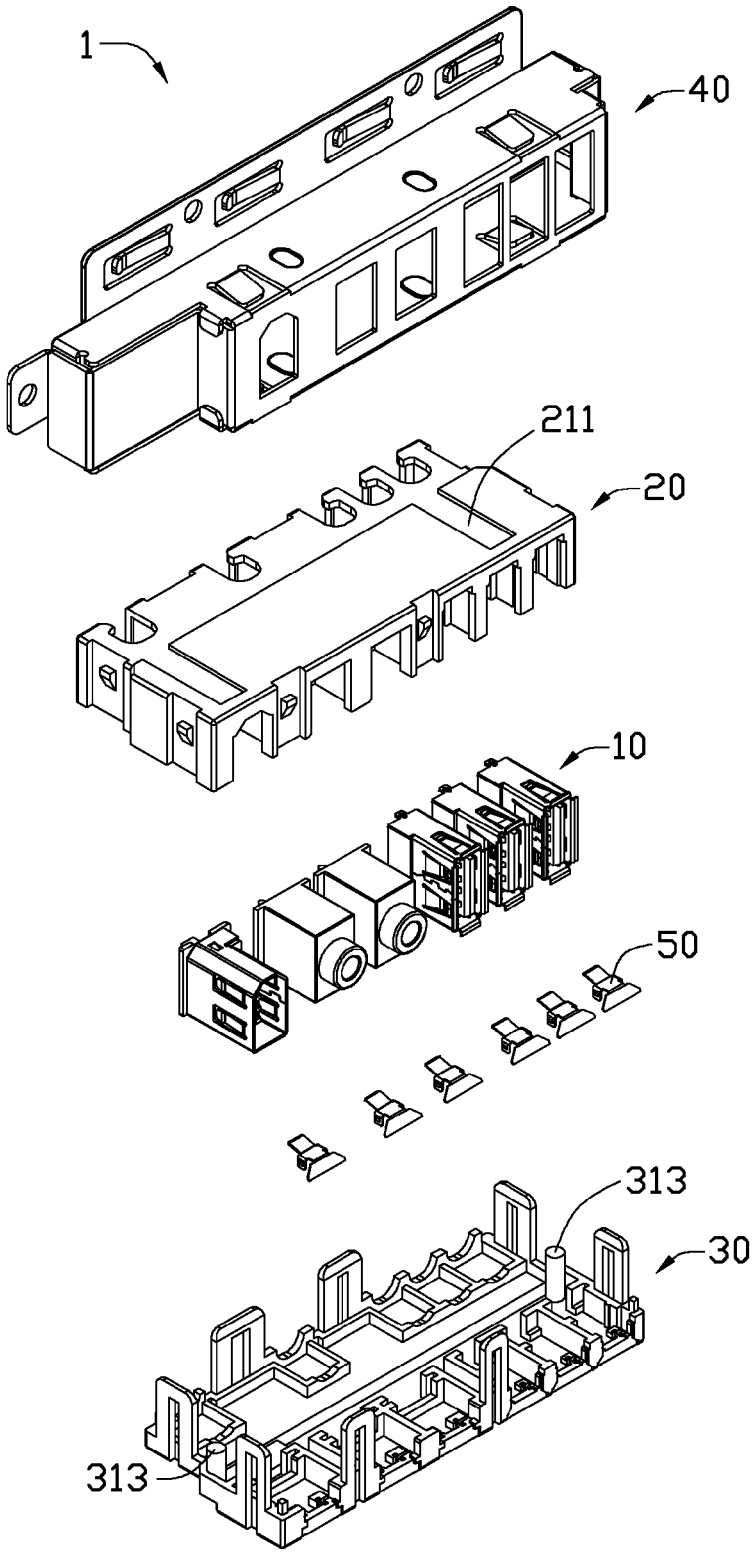
FIG. 2 is similar to FIG. 1, but viewed in a different aspect.
Figure 3:
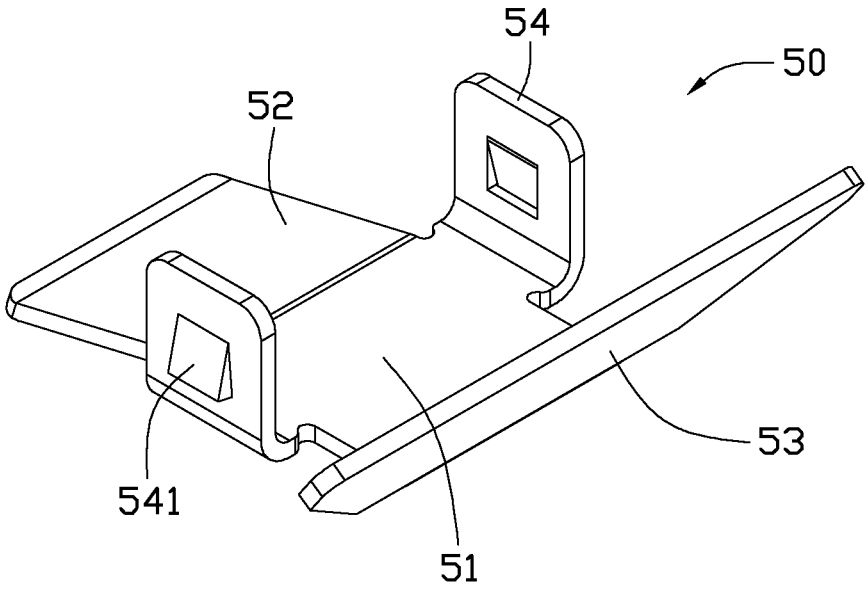
FIG. 3 is a perspective view of a resilient piece of FIG. 1.
Figure 4:
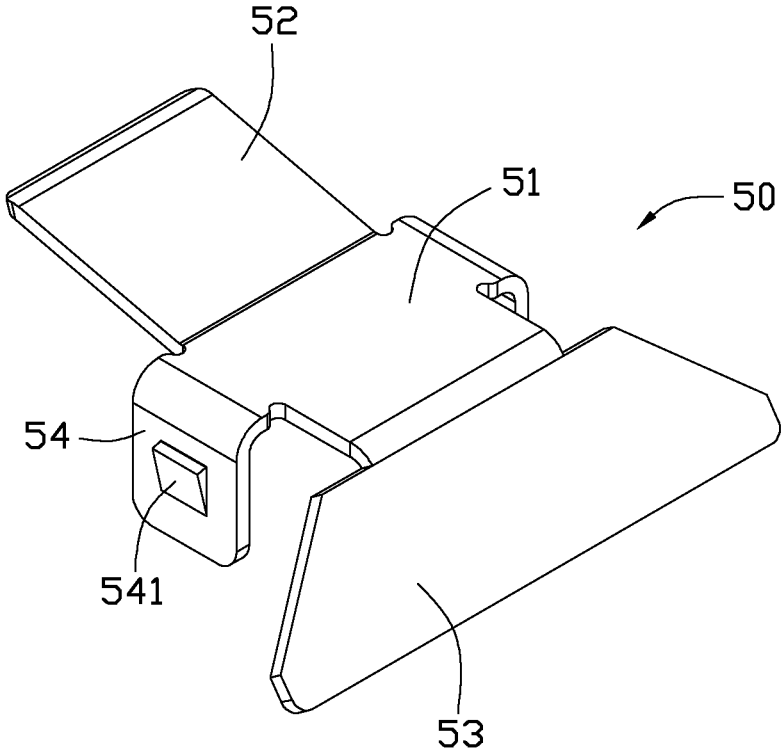
FIG. 4 is similar to FIG. 3, but viewed in a different aspect.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

FIGS. 1-4, show a mounting apparatus 1 in accordance with an embodiment capable of mounting a plurality of I/O connectors 10 in a computer chassis of a computer system (not shown). The mounting apparatus 1 includes a base 20, a cover 30, a shielding case 40 and a plurality of resilient pieces 50.

The plurality of I/O connectors 10 may be, for example, a universal serial bus (USB) port connector, an audio port connector, a 1394 port connector, or other type of port connector. Each of the plurality of I/O connectors 10 may include a housing 11 and a port 12.

The base 20 may include a plate 21 and two sidewalls 22 substantially perpendicular to the plate 21. A plurality of chambers 23 is disposed on an interior side of the plate 21. Each of the plurality of chambers 23 may accommodate one of the plurality of I/O connectors 10. At least one guide groove 221 is defined on an exterior side of each of the two sidewalls 22. A wedge-shaped block 223 protrudes from a bottom bed of each of the at least one guide groove 221. A hollow cylinder 225 is located at each of the two sidewalls 22. Two limiting grooves 211 are defined in an exterior side of the plate 21. The base 20 is made of electrically non-conductive material such as plastics.

The cover 30 may include a board 31 and a plurality of latching pieces 32 downwardly (viewed in the aspect of FIG. 1) extending from the edges of the board 31. A latching hole 321 is defined in each of the plurality of latching pieces 32. A plurality of securing slots 311 are defined in pairs in the board 31. Each pair of the plurality of securing slots 311 is adjacent to the front edge of the board 31 (viewed in the aspect of FIG. 1). Two limiting channels 312 are defined on an exterior side of the board 31 and two positioning posts 313 are located on an interior side of the board 31. The cover 30 is made of electrically non-conductive material such as plastics.

The shielding case 40 may include a top wall 41, a bottom wall 42 substantially parallel to the top wall 41 and a front wall 43 perpendicular to the top wall 41 and the bottom wall 42. Two restricting pieces 411 are defined in the top wall 41. Two spring clips 421 are defined in the bottom wall 42. A plurality of insertion holes 431 for exposing the ports 12 of the plurality of I/O connectors 10 is defined in the front wall 43. The shielding case 40 is made of electrically conductive material such as metal. The shielding case 40 may be installed in a metal chassis of a computer system (not shown) and electrically connected to the metal chassis.

Each of the plurality of resilient pieces 50 may include a main body 51, a first end 52 and a second end 53. The first end 52 and the second end 53 extend from two opposite edges of the main body 51 along two opposite directions. An obtuse angle is defined between the first end 52 and the main body 51. Another obtuse angle is defined between the second end 53 and the main body 51. The second end 53 is an isosceles trapezoid. Two securing pieces 54 extends from the other opposite edges of the main body 51 and the two securing pieces 54 are substantially perpendicular to the main body 51. Each of the two securing pieces 54 includes a wedge-shaped protrusion 541. Each of the plurality of resilient pieces 50 is made of electrically conductive material such as metal.

Figure 5:
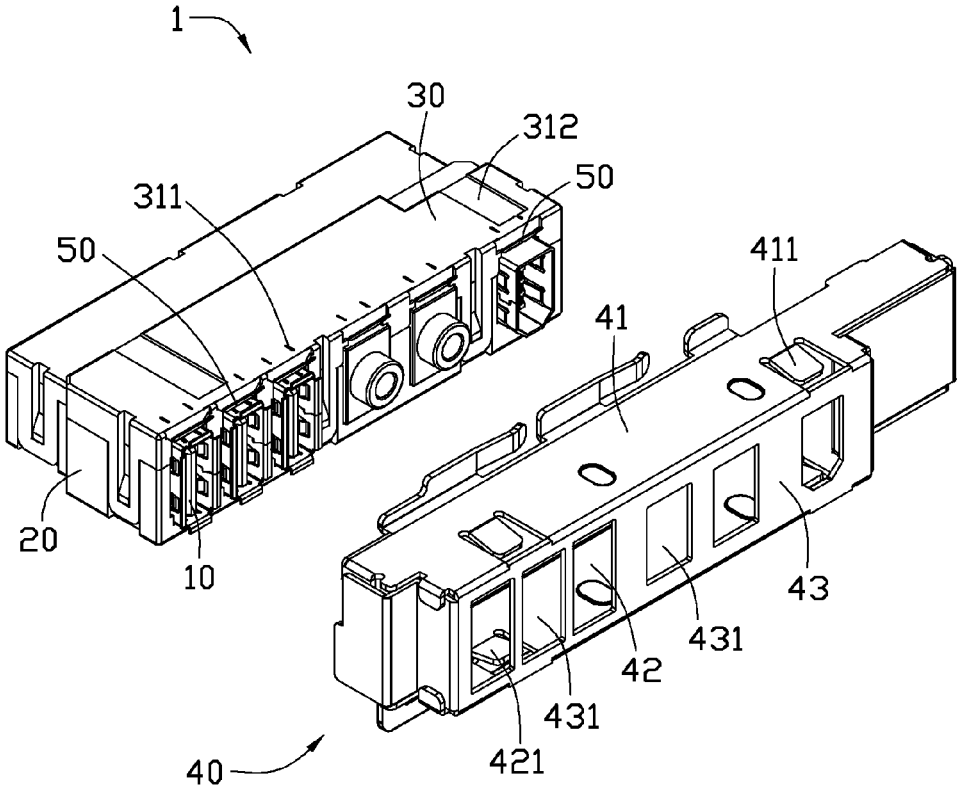
FIG. 5 is a partial assembled view of the mounting apparatus of FIG. 1.

Referring to FIG. 5, in assembly, the two securing pieces 54 of each of the plurality of resilient pieces 50 is inserted into a corresponding pair of the plurality of securing slots 311 of the cover 30. The wedge-shaped protrusion 541 of each of the two securing pieces 54 is snap joint with a corresponding one of the plurality of securing slots 311 so as to prevent each of the plurality of resilient pieces 50 from moving away from the board 31 of the cover 30. The plurality of resilient pieces 50 are secured to the cover 30.

Each of the plurality of I/O connectors 10 is put into one of the plurality of chambers 23 of the base 20. The cover 30 is moved above the base 20. Each of the two positioning posts 313 is aligned with corresponding one of the hollow cylinder 225 and each of the plurality of latching pieces 32 is aligned with corresponding one of the at least one guide groove 221. The cover 30 is moved towards the base 20 and each of the plurality of latching pieces 32 slides into the corresponding one of the at least one guide groove 221 until the plurality of latching pieces 32 are all latched to the at least one guide groove 221 by respectively engaging the latching holes 321 with the wedge-shaped block 223. The two positioning posts 313 are inserted into the hollow cylinder 225. Thereby, each of the plurality of I/O connectors 10 is fixed in one of the plurality of chambers 23 and the first end 52 of each of the resilient pieces 50 abuts the housing 11 of a corresponding one of the plurality of I/O connectors 10. The second end 53 of each of the resilient pieces 50 exposes out of the assembly of the plurality of I/O connectors 10, the base 20, the cover 30 and the resilient pieces 50.

Figure 6:
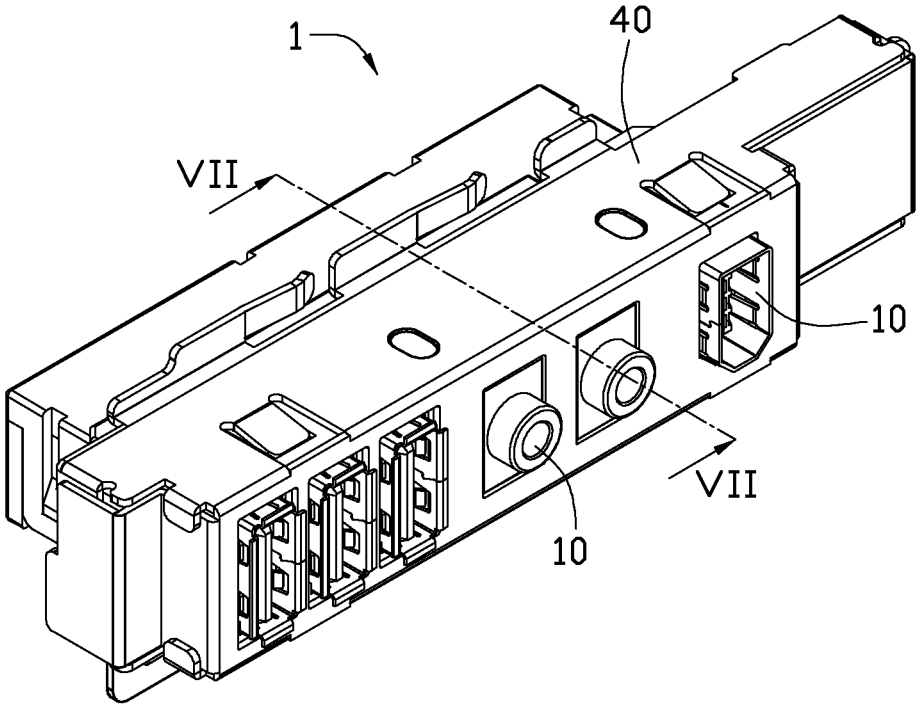
FIG. 6 is an assembled view of the mounting apparatus of FIG. 1.
Figure 7:
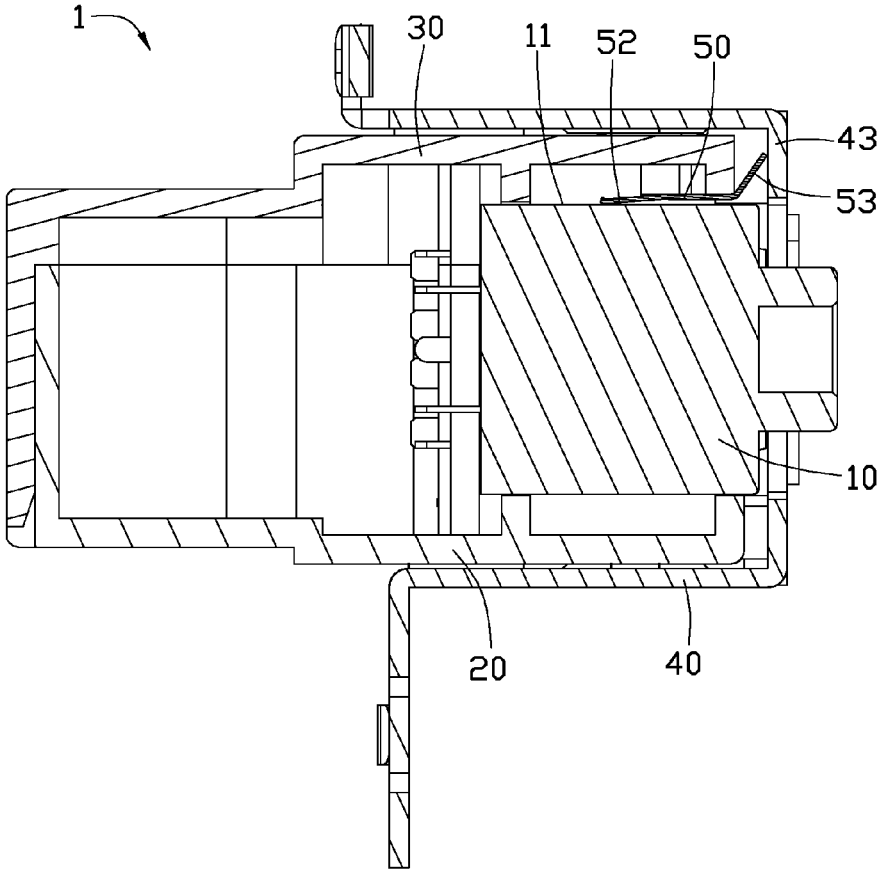
FIG. 7 is a perspective cross sectional view taken along line VII-VII of FIG. 6.

Referring to FIGS. 6 and 7, when installing the assembly of the plurality of I/O connectors 10, the base 20, the cover 30 and the resilient pieces 50 into the shielding case 40, each of the plurality of I/O connectors 10 is aligned with corresponding one of the plurality of insertion holes 431. The assembly of the plurality of I/O connectors 10, the base 20, the cover 30 and the resilient pieces 50 is moved into an accommodating room (not shown) formed by the top wall 41, the bottom wall 42 and the front wall 43 of the shielding case 40. The two restricting pieces 411 of the shielding case 40 are respectively received in the two limiting channels 312 of the cover 30. The two spring clips 421 of the shielding case 40 are respectively received in the two limiting grooves 211 of the base 20. Thereby, the two restricting pieces 411 abut the board 31 of the cover 30 and the two spring clips 421 abut the plate 21 of the base 20. The second end 53 of each of the resilient pieces 50 abuts the interior side of the front wall 43 of the shielding case 40.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A mounting apparatus for mounting an input/output (I/O) connector, the mounting apparatus comprising:

a base comprising a chamber, the chamber being configured to accommodate the I/O connector;

a cover engaged with the base thereby fixing the I/O connector in the chamber;

a shielding case configured to receive base and the cover; and a resilient piece comprising a first end abutting the shielding case and a second end abutting a housing of the I/O connector.

2. The mounting apparatus of claim 1, wherein the shielding case defines an insertion hole configured to expose a port of the I/O connector.

3. The mounting apparatus of claim 1, wherein the resilient piece is secured to the cover.

4. The mounting apparatus of claim 3, wherein the cover comprises two securing slots, and the resilient piece comprises two securing pieces, each of the two securing pieces is inserted into corresponding one of the two securing slots.

5. The mounting apparatus of claim 4, wherein each of the two securing pieces comprises a wedge-shaped protrusion snappily joint with corresponding one of the two securing slots such that the two resilient pieces are prevented from moving away from the cover.

6. The mounting apparatus of claim 1, wherein the resilient piece comprises a main body, the first end and the second end extend from two opposite edges of the main body along two opposite directions.

7. The mounting apparatus of claim 6, wherein a first obtuse angle is defined between the first end and the main body, a second obtuse angle is defined between the second end and the main body.

8. The mounting apparatus of claim 1, wherein the second end is an isosceles trapezoid.

9. The mounting apparatus of claim 1, wherein the shielding case comprises a top wall, a bottom wall substantially parallel to the top wall, and a front wall perpendicular to the top wall and the bottom wall.

10. The mounting apparatus of claim 9, the second end of the resilient piece abuts an interior side of the front wall.

11. The mounting apparatus of claim 1, wherein both the resilient piece and the shielding case are made of electrically conductive material.

12. The mounting apparatus of claim 1, wherein both the base and the cover are made of electrically non-conductive material.

13. An assembly, comprising:

a plurality of input/output (I/O) connectors, each of the plurality of I/O connectors comprising a metal housing and a port;

a base comprising a plurality of chambers, the plurality of chambers being configured to accommodate the plurality of I/O connectors;

a cover configured to be engaged with the base thereby fixing the plurality of I/O connectors in the plurality of chambers;

a shielding case configured to receive the base and the cover, the shielding case is made of electrically conductive material; and a plurality of resilient pieces made of electronic conductive material, each of the plurality of resilient pieces comprising a first end abutting the shielding case and a second end abutting the metal housing of one of the plurality of I/O connectors.

14. The assembly of claim 13, wherein the shielding case defines a plurality of insertion holes configured to expose the ports of the plurality of I/O connectors.

15. The assembly of claim 13, wherein the cover comprises a plurality of pairs of securing slots, and each of the plurality of resilient pieces comprises a pair of securing pieces inserted into a corresponding pair of securing slots.

16. The assembly of claim 15, wherein each of the pair of securing pieces comprises a wedge-shaped protrusion snappily joint with a corresponding securing slot such that the plurality of resilient pieces are prevented from moving away from the cover.

17. The assembly of claim 13, wherein each of the plurality of resilient pieces comprises a main body, the first end and the second end of a resilient piece extend from two opposite edges of the main body of the resilient piece along two opposite directions.

18. The assembly of claim 17, wherein a first obtuse angle is defined between the first end and the main body, a second obtuse angle is defined between the second end and the main body.

19. The assembly of claim 13, wherein the second end is an isosceles trapezoid.

20. The assembly of claim 13, wherein the shielding case comprises a top wall, a bottom wall substantially parallel to the top wall, and a front wall perpendicular to the top wall and the bottom wall, the second end of each of the plurality of resilient pieces abuts an interior side of the front wall.

* * * * *